US008951381B2

(12) United States Patent
Maus et al.

(10) Patent No.: US 8,951,381 B2
(45) Date of Patent: Feb. 10, 2015

(54) QUICK RELEASE HEAD FOR TAPE APPLICATOR

(75) Inventors: Brian Maus, Britton, MI (US); Thomas Truman, Toledo, OH (US)

(73) Assignee: First Solar, Inc., Perrysburg, OH (US)

( * ) Notice: Subject to any disclaimer, the term of this patent is extended or adjusted under 35 U.S.C. 154(b) by 249 days.

(21) Appl. No.: 13/451,635

(22) Filed: Apr. 20, 2012

(65) Prior Publication Data

US 2012/0267047 A1 Oct. 25, 2012

Related U.S. Application Data

(60) Provisional application No. 61/478,890, filed on Apr. 25, 2011.

(51) Int. Cl.
*B65H 35/00* (2006.01)

(52) U.S. Cl.
CPC .... *B65H 35/0013* (2013.01); *B65H 2402/5155* (2013.01)
USPC ..... 156/313; 156/523; 156/577

(58) Field of Classification Search
CPC ..... B65H 35/0033; B65H 2301/531; B29C 65/5092; B29C 70/388; H01L 21/67132
USPC ..... 156/313, 306.6, 306.9, 523–527, 156/574–577
See application file for complete search history.

(56) References Cited

U.S. PATENT DOCUMENTS

| | | | | |
|---|---|---|---|---|
| 4,581,096 | A * | 4/1986 | Sato | 156/513 |
| 6,544,367 | B1 | 4/2003 | Fujimoto et al. | |
| 6,796,351 | B1 | 9/2004 | Maeda | |
| 6,930,238 | B2 * | 8/2005 | Makita et al. | 136/251 |
| 7,093,642 | B2 | 8/2006 | Sharp et al. | |
| 7,105,068 | B2 | 9/2006 | Briese et al. | |
| 7,946,328 | B2 | 5/2011 | Fox et al. | |
| 8,057,627 | B2 | 11/2011 | Herz et al. | |
| 2002/0124967 | A1 * | 9/2002 | Sharp | 156/378 |
| 2006/0037689 | A1 * | 2/2006 | Briese et al. | 156/71 |
| 2006/0118244 | A1 * | 6/2006 | Zaballos et al. | 156/510 |
| 2006/0162143 | A1 | 7/2006 | Nelson et al. | |
| 2009/0084504 | A1 | 4/2009 | Lam et al. | |
| 2009/0218048 | A1 * | 9/2009 | Fox et al. | 156/468 |
| 2012/0037313 | A1 | 2/2012 | Malik et al. | |

FOREIGN PATENT DOCUMENTS

| | | |
|---|---|---|
| WO | WO0056649 | 9/2000 |

* cited by examiner

*Primary Examiner* — John Goff
*Assistant Examiner* — Scott W Dodds
(74) *Attorney, Agent, or Firm* — Dickstein Shapiro LLP

(57) ABSTRACT

A double sided tape applicator can include a quick release head to facilitate, for example, cleaning and tape threading.

6 Claims, 6 Drawing Sheets

QUICK RELEASE HEAD FOR TAPE APPLICATOR

CLAIM OF PRIORITY

This application claims priority under 35 U.S.C. §119(e) to U.S. Provisional Patent Application Ser. No. 61/478,890 filed on Apr. 25, 2011, which is hereby incorporated by reference in its entirety.

TECHNICAL FIELD

The present invention relates to a tape applicator with a quick release head and a method for manufacturing photovoltaic modules.

BACKGROUND

A photovoltaic (PV) module converts light to electricity. During manufacturing of the module, strips of conductive foil can be used to make electrical connections within the module. For example, strips of conductive foil can be used to connect one or more sub-modules within the module. To prevent movement of the foil strips, which can result in shorting, sections of double sided tape may be applied between the foil strips. The double sided tape may be applied using an automated tape applicator, and the applicator may include a head through which the adhesive tape is routed. During use, the head may experience a build-up of adhesive from the passing tape. The build-up of adhesive can reduce accuracy and reliability of the tape applicator.

DETAILED DESCRIPTION

During the manufacture of a photovoltaic module, strips of conductive foil may serve as positive and negative leads to a module. Often the foil leads are stacked on top of each other and an insulating tape is positioned between the foil leads. The insulating tape prevents short-circuiting between the conductive strips. While the tape may be positioned manually, it is far more efficient to use an automated tape applicator. Unfortunately, existing tape applicators suffer from frequent accumulation of adhesive left behind by the passing tape. Cleaning and removing the adhesive from the tape applicator requires stopping an assembly line to service the tape applicator. Since the tape applicator must be cleaned frequently, downtime associated with servicing the tape applicator can be considerable. Therefore, to remedy the shortcomings of existing tape applicators, an improved tape applicator with a quick release head has been devised and is set forth herein.

Figure 1:
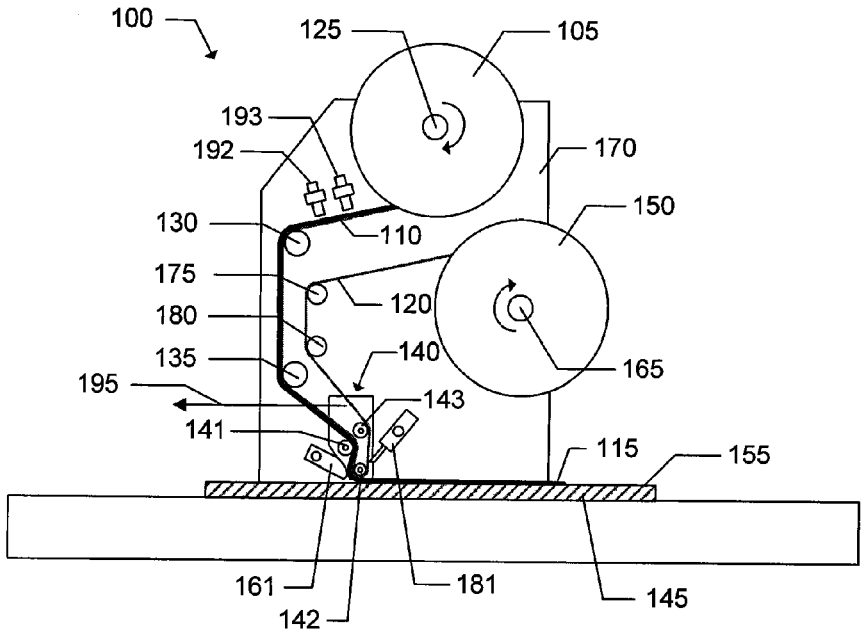
FIG. 1 is a side view of a double sided tape applicator.

Referring by way of example to FIG. 1, a tape applicator 100 may be configured to apply tape 110 to a surface. For example, the tape applicator 100 may be configured to apply tape 110 onto a surface 155 of a photovoltaic module 145. The tape 110 may be any suitable double-sided tape, such as 3M's Double Coated Dielectric Tape 3514, and may include a primary layer 115 and a backing layer 120. The primary layer 115 may be formed from any suitable insulating material such as polyester (PET). The primary layer may include a first surface and a second surface opposite the first surface, and each surface may be coated with adhesive. The adhesive may be any suitable adhesive such as, for example, acrylic adhesive. The backing layer 120 may be a removable layer that is easily separated from the adhesive-coated primary layer. The backing layer 120 may include, for example, poly-coated craft paper, wax paper, or any other suitable material. Removal of the backing layer 120 may expose adhesive on one surface of the primary layer 115.

Figure 7:
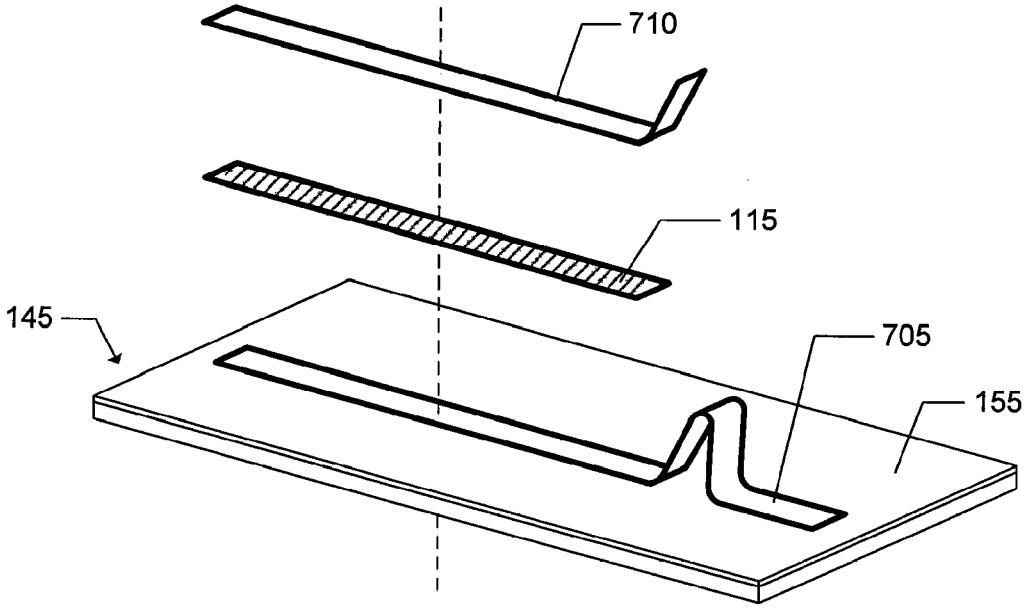
FIG. 7 is an exploded view of a partially assembled photovoltaic module.

Before discussing various aspects of the tape applicator 100, it is useful to discuss a couple of ways in which the tape applicator can be used to manufacture photovoltaic modules. In a first example, as shown in FIG. 7, a partially completed photovoltaic module 145 can include a first conductor 705 and a second conductor 710. The conductors (705, 710) can include any suitable electrical conductor, such as conductive tape or foil and can have any suitable shape. The first and second conductors (705, 710) may serve as positive and negative leads for the module 145.

Figure 8:
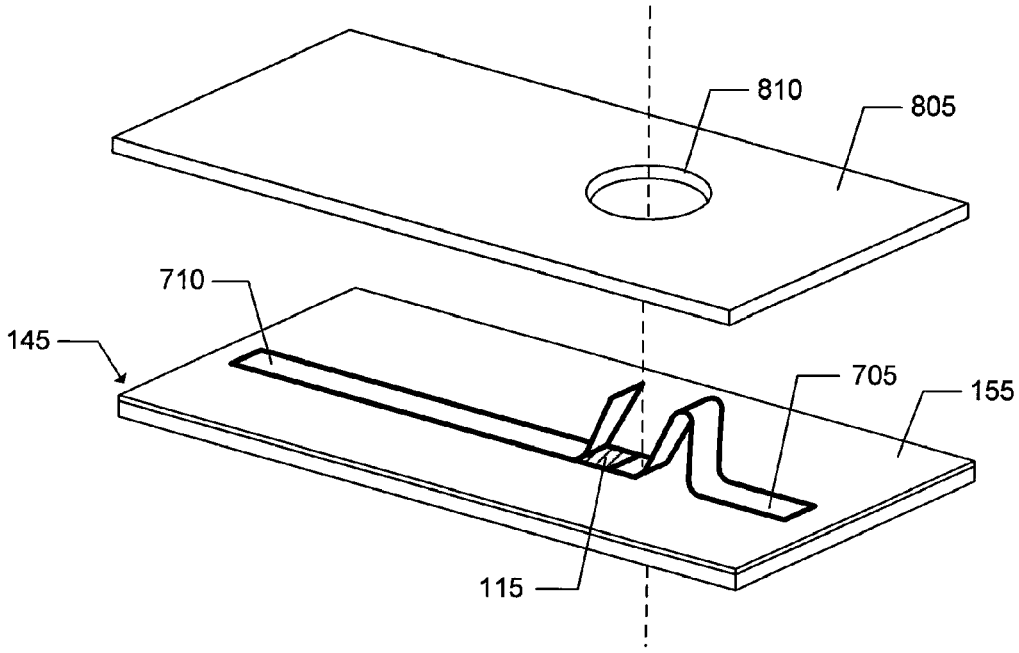
FIG. 8 is an exploded view of a partially assembled photovoltaic module.
Figure 9:
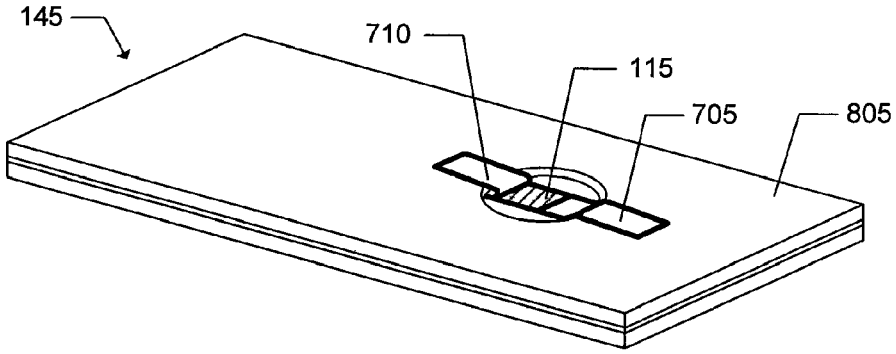
FIG. 9 is a perspective view of a partially assembled photovoltaic module.

During manufacturing, the primary layer 115 of tape may be applied between the first and second conductors (705, 710) and may serve as an insulating barrier between the conductors. For example, when manufacturing the module 145, the first conductor 705 may be formed adjacent to a surface 155 of the module 145. Then, the primary layer 115 of tape may be formed adjacent to the first conductor 705, and the second conductor 710 may be formed adjacent to the primary layer 115 of tape. The relative positions of the primary layer 115 of tape and the conductors (705, 710) are shown in FIG. 7, which shows an exploded view of a partially assembled module 145. Once the conductors (705, 710) and the primary layer 115 of tape have been formed, a cover plate 805 having an opening 810 may be added to the module 145 as shown in FIG. 8. The first and second sections of conductor (705, 710) may then be folded back against the cover plate 805 to serve as positive and negative leads for the module 145, as shown in FIG. 9. A junction box, also known as a cord plate, may be placed over the positive and negative leads, thereby facilitating electrical connectivity to other modules or components.

Figure 14:
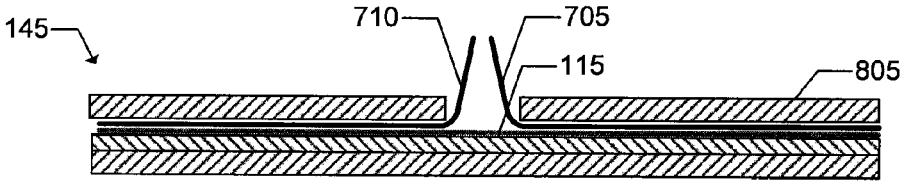
FIG. 14 is a side view of a partially assembled photovoltaic module.
Figure 15:
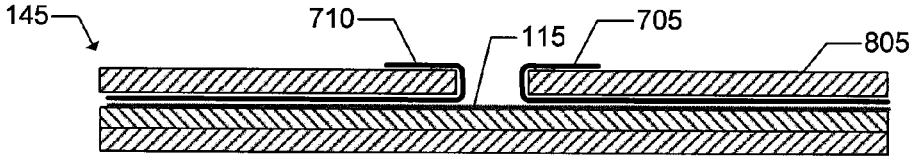
FIG. 15 is a side view of a partially assembled photovoltaic module.

In a second example, as shown in FIGS. 11-15, the primary layer 115 of tape may be applied to the surface 155 of the partially completed photovoltaic module 145. A single conductor 1105 may then be formed adjacent to the primary layer 115 of tape. A loop 1110 may be formed in the conductor thereby allowing it to protrude through the opening 810 in the cover plate 805, as shown in the cross-sectional side view in FIG. 13. Once the cover plate 805 has been installed, the conductor 1105 may be severed to form the first and second sections of conductor (705, 710), as shown in FIG. 14. The first and second sections of conductor (705, 710) may then be folded back against the cover plate 805 to serve as positive and negative leads for the module 145, as shown in FIG. 15. A junction box, also known as a cord plate, may be placed over the positive and negative leads, thereby facilitating electrical connectivity to other modules or components.

Figure 6:
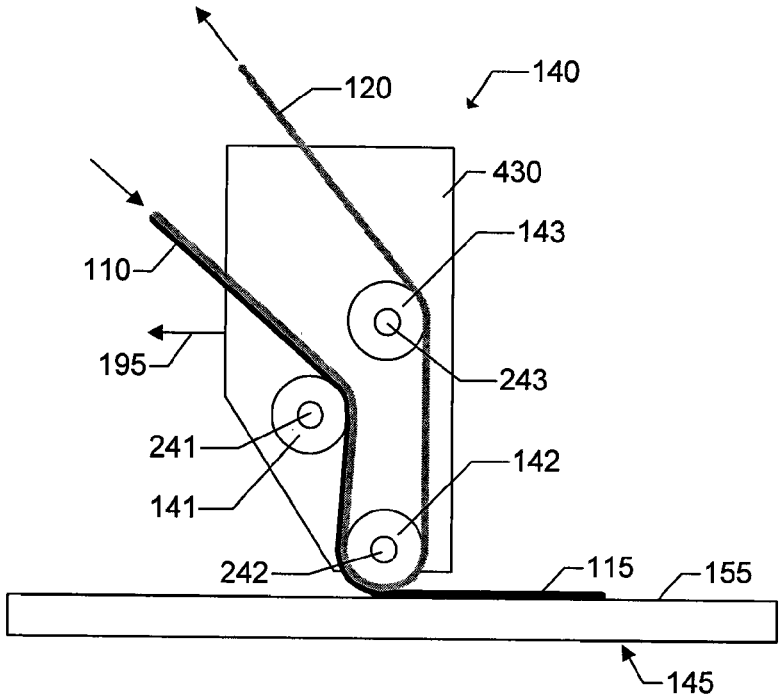
FIG. 6 is a side view of a double sided tape applicator.

The tape applicator 100 may include a quick-release head 140 attached to a body 170 of the applicator 100 as shown, by way of example, in FIG. 1. The head 140 may include a plurality of rollers (e.g. 141, 142, 143), and the rollers may be attached to the head 140 by a plurality of axles (e.g. 241, 242, 243). The tape 110 may be routed through the rollers as shown in FIGS. 1 and 6. In particular, the tape 110 may pass against a first roller 141 before contacting the second roller 142. The second roller 142 may press the tape 110 against the surface 155 of the module 145 thereby causing the primary layer 115 to bond to the surface 155 of the module 145. The backing layer 120 is then stripped away from the primary layer 115 and fed past a third roller 143 before being collected by a rewind roll 150 which may be rotatably mounted to a second spindle 165 that is connected to the body 170 of the applicator 100.

As the tape 110 passes through the rollers, adhesive residue from the primary layer 115 may accumulate on the rollers (e.g. 141, 142). The accumulation of adhesive residue may produce undesirable consequences. For instance, the adhesive residue may cause the rollers (e.g. 141, 142) to bind, thereby adversely affecting tape placement on the surface 155 of the module 145. Accurate tape placement is vital, because the primary layer 115 may serve as an insulating barrier within the module 145. For example, the primary layer 115 may serve as an insulating barrier between the first and second conductors (705, 710). Thus, poor placement of the primary layer 115 may result in short circuiting within the module and should therefore be avoided. Also, adhesive residue that accumulates on the rollers (e.g. 141, 142) may be transferred to the module, which can diminish the module's appearance as well as decrease long-term reliability. For instance, an unwanted mass of adhesive may create a stress concentration within the module that promotes separation of module layers. Separation of layers is undesirable since it may allow moisture to enter the module. Moisture is undesirable since it can reduce the module's performance by corroding electrical connections within the module.

To prevent excessive accumulation of adhesive residue on the rollers (e.g. 141, 142), the rollers must be cleaned periodically. In previous tape applicators, cleaning was accomplished by disassembling the applicator head 140 to access the rollers. This process required shutting down the assembly line while the rollers were being cleaned. As a result, productivity of the assembly line was reduced. Also, workers were forced to balance the desire to quickly restart the assembly line against thoroughly cleaning the rollers. Consequently, the rollers (e.g. 141, 142) may not have been cleaned as regularly or as thoroughly as might be preferred.

To overcome limitations associated with existing tape applicators, a quick release head 140 for a tape applicator 100 is set forth. The quick release head may be rapidly removed from the tape applicator 100 to facilitate thorough cleaning of the rollers. For example, the quick release head 140 may be removed by hand without the use of tools. Upon removing the head 140, a replacement head can be quickly installed in its place. This results in minimal downtime of the assembly line while also allowing for thorough cleaning of the rollers within the removed head 140.

Figure 10:
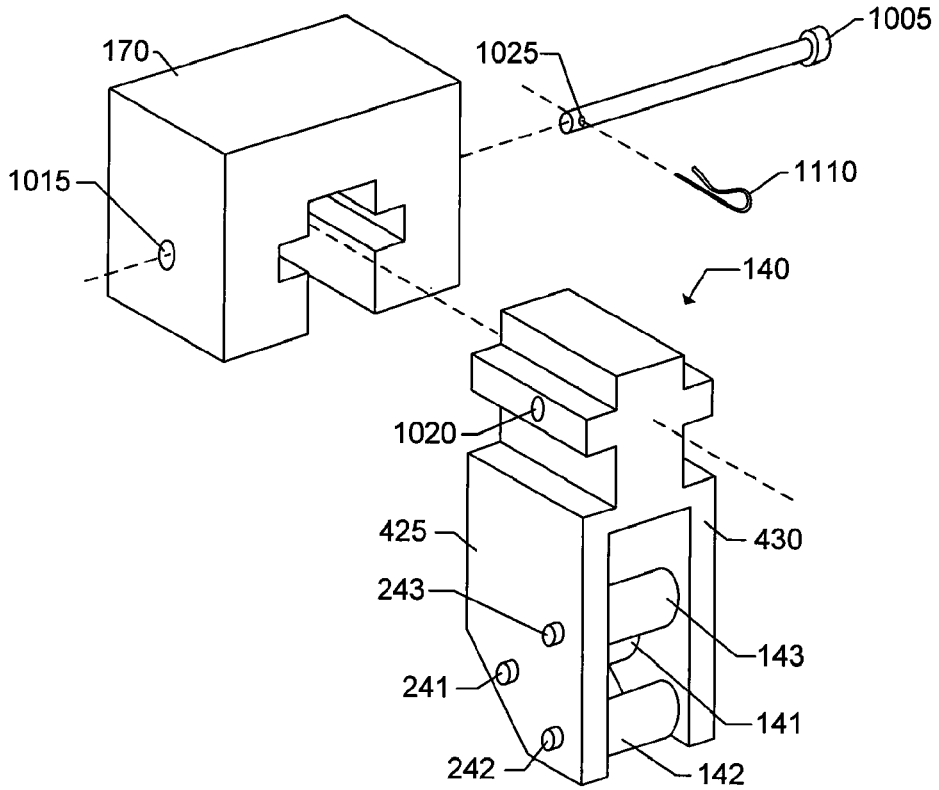
FIG. 10 is a perspective view of an example quick release head.
Figure 11:
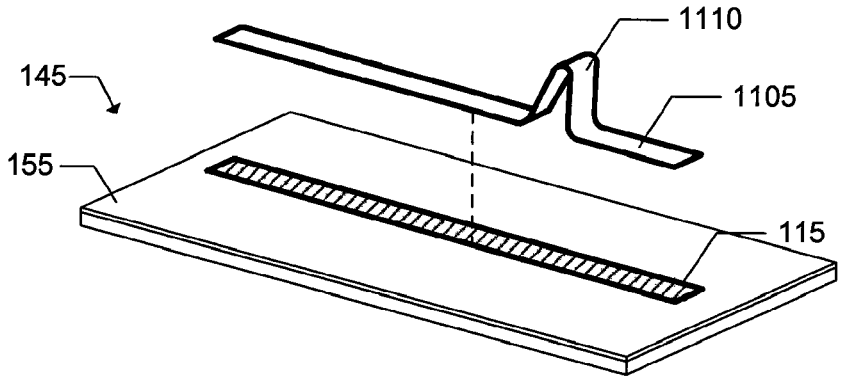
FIG. 11 is an exploded view of a partially assembled photovoltaic module.
Figure 12:
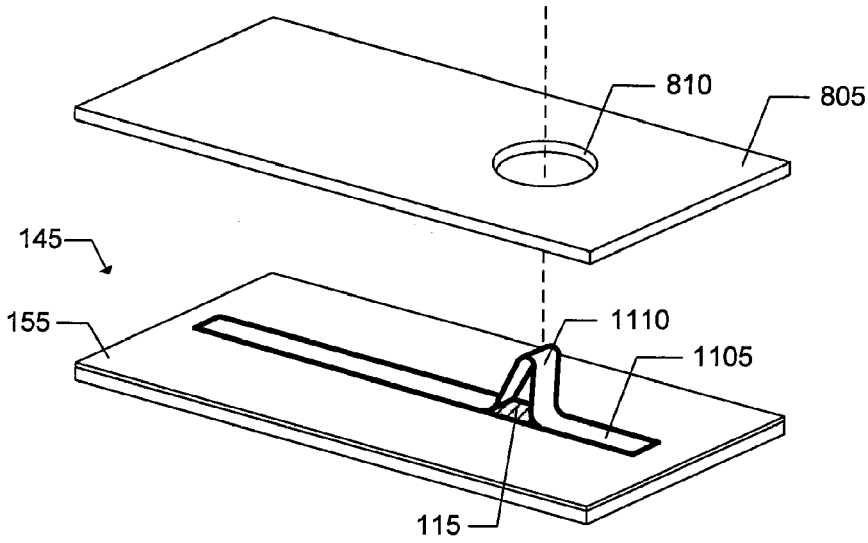
FIG. 12 is an exploded view of a partially assembled photovoltaic module.
Figure 13:
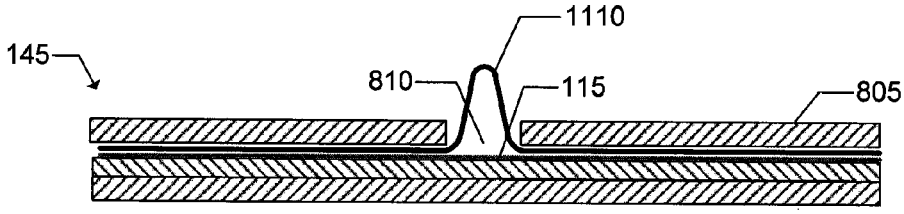
FIG. 13 is a side view of a partially assembled photovoltaic module.

The quick release head 140 may include one or more quick release devices configured to attach the head 140 to the tape applicator 100, and each quick release device may include suitable type of quick release device. For instance, the quick release device may include a bolt 1005 secured with a cotter pin 1110 as shown in FIG. 10. In particular, the quick release head 140 may have a shape configured to be received by the body 170 of the tape applicator 100. Once the head 140 is attached to the body 170, the bolt 1005 may be inserted through a hole 1015 in the body 170 that is aligned with a hole 1010 in the body 170. Once the bolt is inserted through both holes, it may be secured by inserting a cotter pin 1110 through a hole 1025 in the end of the bolt 1110. Although a bolt and a cotter pin are described, any other suitable retention mechanism can be used.

Figure 4:
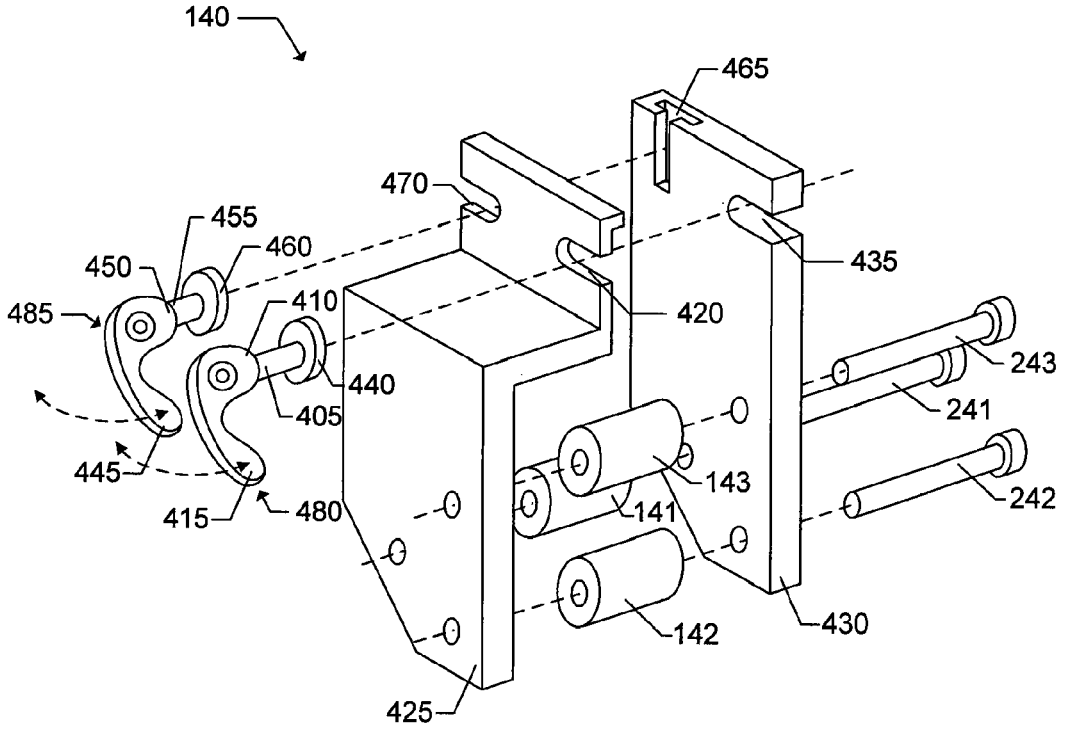
FIG. 4 is an exploded view of an example quick release head.
Figure 5:
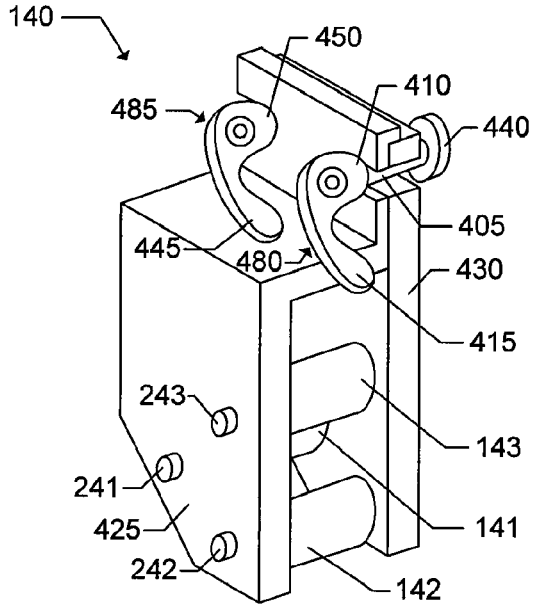
FIG. 5 is a perspective view of an example quick release head.

In another example, the quick release device may include a first quick release skewer 480 as shown in FIGS. 4 and 5. The first quick release skewer 480 may include a first skewer 405 attached to a first lever 415 having a cam portion 410. As shown in FIG. 4, the first skewer 405 may pass through a first opening 420 in a first portion 425 of the head 140 and a second opening 435 in a second portion 430 of the head 100. On an end opposite the cam portion 410, the skewer may be connected to a nut 440, plate, or similar feature. The nut 440 may be captured in a slot (not shown) on the tape applicator 100. Once inserted into the first and second openings (420, 435) as shown in FIG. 5, actuation of the lever 415 rotates the cam portion 410 and increases the amount of clamping force applied between the cam portion 410 and a nut 440. Therefore, if the nut 440 is securely captured in a slot, actuation of the lever 415 applies a force between the cam portion 410 and the nut 440 that acts to non-permanently join the first and second portions (425, 430) of the head 140 to the body 170 of the tape applicator 100. Thus, the head 140 can be securely attached to the tape applicator 100 simply by closing the lever 415. Similarly, the head 140 can be quickly removed from the tape applicator 100 by opening the lever 415.

To facilitate easy cleaning of the rollers (e.g. 141, 142), the first portion 425 and second portion 430 of the head 140 may also be connected by a second quick release device. The second quick release device can be any suitable quick release device. For example, as shown in FIGS. 4 and 5, the first and second portions (425, 430) may be connected by a second quick release skewer 485. Similar to the first quick release skewer 480, the second quick release skewer 485 may also include a second skewer 455 extending between a second cam portion 450 and a second nut 460. The second cam portion 450 may be attached to a second lever 445. During installation, the second skewer 455 may pass through a third opening 470 on the first portion 425 of the head 140. The second portion 43G of the head 140 may contain a slot 465 configured to receive the second nut 460. Actuation of the second lever 445 applies a force between the second cam portion 450 and the second nut 460 that acts to non-permanently join the first and second portions (425, 430) of the head 140. Thus, the first and second portions (425, 430) can be securely joined simply by closing the lever 445. Similarly, the first and second portions can be quickly disassembled simply by opening the lever 445.

Figure 2:
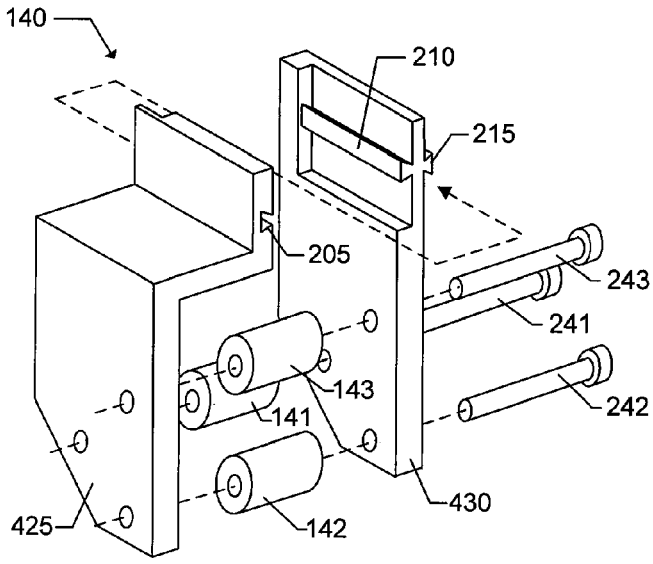
FIG. 2 is an exploded view of an example quick release head.
Figure 3:
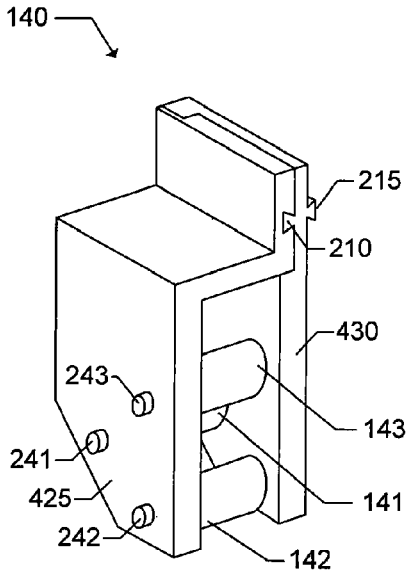
FIG. 3 is a perspective view of an example quick release head.

Alternately, the quick release device may include interlocking features as shown in FIGS. 2 and 3. A first mating feature 205 on the first portion 425 of the head 140 may be configured to receive a second mating feature 210 on the second portion 430 of the head 140 as shown in FIG. 2. The second mating feature 210 may be configured to slide into the first mating feature 205 as shown in FIG. 3. The second mating feature 210 may be retained within the first mating feature 205 by friction or by a retention device. This configuration allows for easy access to the rollers (e.g. 141, 142) for cleaning purposes. Easy removal of the first portion 425 of the head 140 may also be desirable when feeding tape 110 through the rollers during setup prior to commencing manufacturing. For example, when the tape supply roll 105 is depleted, a new supply roll 105 must be loaded onto the first spindle 125. Once loaded, a tape end from the supply roll 105 must be fed through the rollers, and the secondary layer 120 must be stripped from the primary layer 115 near the second roller 142. With the first portion 425 of the head 140 removed, these tasks can be completed much faster than with previous tape applicators, thereby decreasing downtime and increasing productivity.

The head 140 may be attached to the body 170 of the tape applicator 100 using interlocking features. As shown in FIGS. 2 and 3, the second portion 430 of the head 140 may include a third mating feature 215. The third mating feature 215 may be configured to slide into a fourth mating feature (not shown) on the body 170 of the tape applicator 100. The third mating feature 215 may be retained within the fourth mating feature by friction or by a retention device. This configuration allows for easy and rapid removal of the entire quick release head 140 when cleaning is required. Once removed, a replacement head 140 can easily and quickly be inserted in place of the original head, and manufacturing can resume. The original quick release head 140 can then be disassembled and cleaned without significantly disrupting the manufacturing process.

Although quick-release heads 140 having a first portion 425 and a second portion 430 independent from the first portion 425 are described, this is not limiting. For example, the head 140 may include a first portion 425 and a second portion 430 that are part of a single structural element, as shown in FIG. 10. To clean the rollers (e.g. 141, 142), the axles (e.g. 241, 242) may be removed to allow for removal of the rollers. The rollers may then be cleaned independently of the head 140. For example, the rollers may be cleaned with solvent to remove the adhesive residue. Alternately, the entire head may be cleaned with the rollers attached. In one example, the head 140 may be submerged into an ultrasonic cleaner. The cleaner may contain a solvent solution, and the solvent solution may include surfactants and detergents capable of removing the adhesive residue from the rollers.

The quick release head is discussed in detail above. For completeness, it is also useful to discuss the other components of the tape applicator 100. For instance, the tape applicator may include supply cassette containing tape. The tape 110 may be wound around a cylinder, spool, or other suitable core to form the supply cassette 105. The supply cassette 105 may be rotatably mounted to the body 170 of the tape applicator 100. To avoid jamming and to ensure proper placement of the tape 110 on the surface 155, it is desirable to maintain tension within the tape 110. In known apparatuses, tension is maintained with a spring-loaded dancer arm. Alternately, the dancer arm may be replaced by a first torque controller installed proximate to the supply cassette 105. The first torque controller may be installed proximate to the first hub 125 and may be capable of adjusting the resistance torque required to rotate the supply cassette. The torque controller may be capable of adjusting the resistance torque required to rotate the supply cassette from about 5 N-cm to about 50 N-cm.

The supply cassette 105 may be mounted to a first hub 125 that is connected to the body 170 of the apparatus 100. The first hub 165 may be a driven hub. For instance, the first hub 125 may include an electric motor capable of providing torque to the first hub 125 during the application process. The torque applied to the first hub 125 may be controlled with a computer. The first hub 125 may include a first torque sensor. Output from the first torque sensor may be delivered to the computer. By monitoring feedback from the first torque sensor, the computer can adjust the torque delivered to the first hub 125 to improve the dispensing process. For instance, if the first torque sensor indicates that too much torque is being applied to the first hub 125, the first hub torque may be reduced to decrease tension in the tape 110, thereby avoiding tape breakage and possible jamming. Alternately, if the first torque sensor indicates that too little torque is being applied to the first hub 125, the first hub torque may be increased to avoid formation of slack between the supply cassette 105 and application roller 160, which could also result in jamming.

As the supply cassette 105 is depleted during the dispensing process, the outer diameter of the tape roll decreases. As a result, less resistance torque is required to oppose rotation of the hub as the mechanical advantage diminishes. Therefore, if tape 110 is being drawn from the roll at a constant force by a driven roller, the resistance torque must be adjusted to avoid the tension on the tape from being too high or too low. For example, if too much resistance torque is applied to the first hub 125, too much tension may be applied to the tape causing it to stretch or break. Conversely, if too little resistance torque is applied to the hub, the tape may become slack thereby causing jamming.

It may be desirable to adjust the torque applied to the hub 125 over the course of the dispensing process to account for the changing tape roll diameter. For instance, the first torque controller may reduce the resistance torque applied to the hub as the roll diameter decreases over time. A first resistance torque may be applied at a first point in time ($t_1$), and a second resistance torque may be applied at a second point in time ($t_2$), where the first resistance torque is larger than the second resistance torque. In particular, the first resistance torque may range from about 15 N-cm to about 50 N-cm, where $t_1$ corresponds to a tape roll diameter ranging from about 18 cm to about 50 cm. The second resistance torque may range from about 5 N-cm to about 15 N-cm, where $t_2$ corresponds to a tape roll diameter ranging from about 7 cm to about 25 cm. The resistance torque may be adjusted linearly or nonlinearly from $t_1$ to $t_2$. In addition, the resistance torque values may account for material properties of the tape such as tensile strength. For example, the resistance torque may be limited to avoid reaching or exceeding the tape's tensile strength.

The tape 110 may be routed from the supply cassette 105 through one or more pre-application rollers (e.g. 130, 135). The pre-application rollers may guide the tape 110 from the supply cassette 105 to the quick-release head 140. The diameters of the pre-application rollers (e.g. 130, 135) may range from about 2 mm to about 20 mm. Preferably, the diameter of the pre-application rollers (e.g. 130, 135) may range from about 4 mm to about 10 mm. To ensure the tape 110 does not deviate laterally from its target dispensing location, the pre-application rollers (e.g. 130, 135) may have uniform diameters. Thus, by incorporating rollers having equal diameters, tape 110 alignment may be improved. In turn, product quality may be improved, and the dispensing rate may be increased.

As noted above, the tape 110 may be routed from the one or more pre-application rollers (e.g. 130, 135) to the quick-release head 140. Once at the head 140, the primary layer 115 may be dispensed onto the surface 155 of the photovoltaic module 145. During operation, the head 140 may move relative to the module 145, as shown by an arrow 195 in FIG. 1.

Relative movement may result from independent movement of the head 140 or by movement of the body 170 to which the head 140 is connected. For example, the apparatus 100 may be mounted on a rail system and include a drive system which allows it to move axially. As a result, the head 140 may traverse the photovoltaic module 145 and simultaneously apply tape 110 to its surface 155.

The quick release head 140 may provide a downward force against the surface 155 of the module 145, and the tape 110 may be pressed between the second roller 142 and the surface 155 of the module 145. As the head 140 moves relative to the module 145, the tape 110 may be drawn from the supply roller 105 and deposited on the surface 155 of the module 145. To ensure adequate adhesion against the surface 155 of the module 145, the apparatus 100 may include a spring attached to the head 140 to provide downward pressure against the tape 110 and the surface 155. Alternately, any other suitable technique for displacing the head 140 in a downward direction may be used. For example, pneumatic or hydraulic pressure may be used. The diameter of the second roller 142 may range from about 2 mm to about 20 mm. Preferably, the diameter of the second roller 142 may range from about 4 mm to about 10 mm.

As the primary layer 115 of the tape 110 is dispensed onto the surface 155 of the photovoltaic module 145, the backing layer 120 may be stripped from the tape 110 and routed to a rewind roll 150. The purpose of the rewind roll 150 may include collecting the backing layer 120 during the process to avoid complications such as jamming. The rewind roll 150 may be rotatably mounted to the body 170 of the apparatus. For example, the rewind roll 150 may be mounted to a second hub 165 that is connected to the body 170 of the apparatus 100. The second hub 165 may be a driven hub. For instance, the second hub 165 may include an electric motor capable of providing torque to the second hub and collecting the backing layer 120 during the application process. The torque of the second hub 165 may be controlled with a computer. The second hub 165 may include a torque sensor. Output from the torque sensor may be delivered to the computer. By providing feedback, the computer can adjust the torque delivered to the second hub 165 to improve the collection process. For instance, if the torque sensor indicates that too much torque is being applied to the second hub 165, the second hub torque may be reduced to decrease tension on the backing layer 120, thereby avoiding breaking the backing layer 120 which could result in jamming. Alternately, if the torque sensor indicates that too little torque is being applied to the second hub 165, the second hub torque may be increased to avoid slack in the backing layer 120 which may also cause jamming.

The apparatus 100 may include one or more post-application rollers (e.g. 175, 180). The post-application rollers (e.g. 175, 180) may guide the backing layer 120 from the head 140 to the rewind roll 150. The post-application rollers (e.g. 175, 180) may have uniform diameters or non-uniform diameters. The diameters of the post-application rollers may range from about 2 mm to about 20 mm. Preferably, the diameter of the post-application rollers may range from about 4 mm to about 10 mm.

The apparatus 100 may include a gripper 161. The gripper 161 may be located proximate to the head 140 and may be configured to capture the tape against one of the plurality of rollers (e.g. 141, 142) when the process stops. For instance, the computer may actuate the gripper 161 upon stopping the dispensing process. As a result, the gripper 161 may prevent the supply roll 105 from unraveling and causing complications when the application process resumes. The apparatus 100 may include more than one gripper 161, and the grippers may be located at several locations. For example, the apparatus may include one or gripper 161 on the supply roll side and one gripper on the rewind roll side. In particular, a first gripper may be configured to capture the tape 110 against the first roller, and a second gripper may be configured to capture the backing layer 120 against the third roller 143.

Although FIG. 1 depicts a dynamic head 140 and a stationary photovoltaic module 145, this is not limiting. For instance, during manufacturing, the head 140 may remain stationary and the module 145 may move relative to the head 140. The tape applicator 100 may be positioned near, or connected to, a conveyor system. The conveyor system may include a conveyor surface and a drive mechanism for propelling the conveyor surface. The drive mechanism may include, for example, an electric motor and gear assembly capable of transmitting motion to the conveyor surface. The conveyor surface may include a belt, roller, cart, trolley, chain, screw, or any other suitable device for advancing the module 145. A conveyor speed sensor may monitor the speed of the conveyor surface. During manufacturing, the module 145 may be loaded onto the conveyor surface, and the drive mechanism may be activated. The photovoltaic module 145 may travel on the conveyor surface and pass beneath the head 140, and the head 140 may dispense tape onto the surface 155 of the module 145. Although the previous examples describe a stationary applicator paired with a dynamic module and a dynamic applicator paired with a stationary module, this is not limiting. For example, during manufacturing, the head 140 and the photovoltaic module 145 may both move relative to the other.

The applicator 100 may include a sensor 193 to detect the presence of tape 110. The sensor may be any suitable sensor such as, for example, a proximity sensor or a photoeye. The sensor may be configured to detect the presence of tape 110 and provide a signal to the computer. If the tape 110 breaks, or if the supply cassette 105 is depleted of tape 110, the sensor 193 will no longer detect the tape's presence. As a result, the signal being conveyed from the sensor 193 to the computer will change. The computer can respond to the change in signal by, for example, stopping the dispensing process. By stopping the process, the apparatus may avoid producing scrap modules that necessitate rework.

The rate at which the tape 110 is dispensed may be monitored by a speed sensor 192. The speed sensor 192 may be connected to the body 170 of the tape applicator 100. The speed sensor 192 may monitor the dispensing rate by monitoring the linear speed of the tape as it passes the sensor 192. Alternately, the sensor 192 can monitor the rotational speed of either the supply or rewind roller, and dispensing speed can be calculated if roll diameter is known. By multiplying the rotational speed of the roller by the circumference of the roller, the dispensing speed can be calculated. By monitoring the dispensing rate, depletion of the supply cassette 105 can be anticipated and the process can be suspended at an appropriate time to allow for replacement of the empty supply roll 105 with a full roll. The quantity of tape remaining on the supply roll 105 may also be monitored with a stroke counter.

To facilitate real-time calculation and monitoring of the dispensing rate, the output of the speed sensor 192 may be delivered to the computer. To ensure the primary layer 115 is being dispensed in the correct position on the surface of the module 145, the tape applicator 100 may include a machine vision system (not shown) which monitors the position of the tape in a direction normal to the direction of conveyor movement. The vision system may include a Charge Coupled Device (CCD) camera and image processing software. The computer may be configured to simultaneously receive and process signals from multiple inputs such as, for example, the speed sensor 192, conveyor speed sensor 191, and vision system. The computer may include a data acquisition board capable of converting analog signals to digital signals. The computer may monitor, record, and store signal data in a database. Data recorded during the manufacture of the module may be recorded and assigned to that module in the database. Therefore, if a performance issue subsequently arises after the module is deployed in the field, the manufacturing data associated with that module can be reviewed to determine the root cause of the issue.

The computer may include a software program that permits execution of one or more manufacturing processes. For instance, the software may enable application of tape 110 with little or no manual input. A user may place a partially completed module 145 onto the conveyor surface and initiate a program which automatically applies tape 110 as defined in the manufacturing process. The software program may enable display of a graphical user interface (GUI) on a monitor associated with the computer. The GUI may allow a user to input target manufacturing parameters such as conveyor speed, dispensing rate, resistance torques. The GUI may display data acquired from the sensors in real-time while the manufacturing process is running. In addition, the GUI may allow the user to recall test data from the database and create, display, and print charts and graphs generated from the stored data.

The tape applicator 100 may include a cutter 181 configured to sever the tape or one of the tape's layers. The cutter 181 may be attached to the body 170 of the tape applicator 100. Alternately, the cutter 181 may be attached to the head 140. Any suitable method of actuating the cutter 181 may be employed, such as actuation via pneumatic, hydraulic, or electronic methods. For example, the cutter may be an air knife that is pneumatically actuated.

During manufacturing, the cutter 181 may be activated after the proper amount of tape 110 has been dispensed. For instance, based on input parameters, sensor signals, and software code, the computer may detect when the proper amount of tape 110 has been dispensed for a given module. At this moment, the computer may actuate the cutter 181, thereby severing the tape 110. Alternately, at the end of an application cycle, the body 170 may move away the surface 155 of the module 145 so that the tape 110 is brought in close proximity to the cutter 181. As a result, the tape 110 may be lifted against the cutter 181, and the forward movement of the head 140 may advance the cutter 181 through the tape 110, which may already be adhered to the module 145 and, therefore, fixed at one point.

In one aspect, a quick release head for a double sided tape applicator may include a first portion, a second portion substantially parallel to the first portion, a plurality of rollers positioned between the first and second portions, and a first quick release device allowing attachment or removal of the head to or from a double sided tape applicator. The quick release head may include a second quick release device allowing attachment or removal of the first portion to or from the second portion. The plurality of rollers may include a first roller mounted on a first axle, a second roller mounted on a second axle, and a third roller mounted on a third axle, where the first, second, and third axles extend from the first portion to the second portion. The first quick release device may be a quick release skewer. Similarly, the second quick release device is a quick release skewer. Alternately, the first quick release device may include a mating feature on the tape applicator head configured to interlock with a mating feature on the tape applicator. Similarly, the second quick release device may include a mating feature on the first portion configured to interlock with a mating feature on the second portion. The tape applicator may include a cutter mounted to the head, where the cutter is configured to sever tape proximate to the plurality of rollers. The cutter may be a pneumatically actuated blade.

In another aspect, a double sided tape applicator may include a body, a first spindle attached to the body and configured to receive a supply roll, a second spindle attached to the body and configured to receive a rewind roll, and a quick release head attached to the body by a first quick release device. The first quick release device may be a quick release skewer. Alternately, the first quick release device may include a mating feature on the quick release head configured to interlock with a mating feature on the body. The quick release head may include a first portion, a second portion substantially parallel to the first portion, and a plurality of rollers positioned between the first and second portions. The tape applicator head may further include a second quick release device allowing attachment or removal of the first portion to or from the second portion. The plurality of rollers may include a first roller mounted on a first axle, a second roller mounted on a second axle, and a third roller mounted on a third axle, where the first, second, and third axles extend from the first portion to the second portion. The tape applicator may also include a cutter mounted to the head, where the cutter is configured to sever tape routed through the plurality of rollers. Alternately, the tape applicator may include a cutter mounted to the body.

In yet another aspect, a method for manufacturing a photovoltaic module may include forming a first section of conductor adjacent to a partially completed photovoltaic module, applying double sided tape adjacent to the first section of conductor with a tape applicator comprising a first quick release head, and forming a second section of conductor adjacent to the double sided tape. The method may also include removing the first quick release head from the tape applicator by actuating a first quick release device, and attaching a second quick release head to the tape applicator by actuating a first quick release device. The method may further include cleaning the first quick release head while the second quick release head is attached to the tape applicator, and subsequently removing the second quick release head from the tape applicator and re-attaching the first quick release head to the tape applicator.

In another aspect, a method for manufacturing a photovoltaic module may include applying double sided tape adjacent to a partially completed photovoltaic module with a tape applicator comprising a first quick release head. The method may also include forming a conductor adjacent to the double sided tape. The method may include removing the first quick release head from the tape applicator by actuating a first quick release device and attaching a second quick release head to the tape applicator by actuating a first quick release device. The method may include cleaning the first quick release head while the second quick release head is attached to the tape applicator and subsequently removing the second quick release head from the tape applicator and re-attaching the first quick release head to the tape applicator.

Details of one or more embodiments are set forth in the accompanying drawings and description. Other features, objects, and advantages will be apparent from the description, drawings, and claims. Although a number of embodiments of the invention have been described, it will be understood that various modifications may be made without departing from the spirit and scope of the invention. It should also be understood that the appended drawings are not necessarily to scale, presenting a somewhat simplified representation of various features and basic principles of the invention.

What is claimed is:

1. A method for manufacturing a photovoltaic module, the method comprising: forming a first section of conductor adjacent to a partially completed photovoltaic module;

applying double-sided insulating, tape adjacent to the first section of conductor with a first quick release head of a tape applicator, wherein the first quick release head comprises at least one first application roller, a body portion of the first quick release head and a first quick release device;

forming a second section of conductor adjacent to the double-sided tape;

releasing the first quick release head from a body of the tape applicator by actuating the first quick release device, wherein the body of the tape applicator comprises at least a supply roll for supplying the double-sided insulating tape, a rewind roll, and at least one roller; and attaching a second quick release head to the body of the tape applicator, wherein the second quick release head comprises at least one second application roller, a body portion of the second quick release head and a second quick release device.

2. The method of claim 1, further comprising:

at least partially removing an adhesive residue from the at least one roller of the released first quick release head while the second quick release head is attached to the body of the tape applicator; and subsequently releasing the second quick release head from the body of the tape applicator and re-attaching the first quick release head to the body of the tape applicator.

3. A method for manufacturing a photovoltaic module, the method comprising:

applying double-sided insulating tape adjacent to a partially completed photovoltaic module with a first quick release head of a tape applicator, wherein the first quick release head comprises at least one first application roller, a body portion of the first quick release head and a first quick release device;

forming a conductor adjacent to the double-sided tape;

releasing the first quick release head from a body of the tape applicator by actuating the first quick release device, wherein the body of the tape applicator comprises at least a supply roll for supplying the double-sided insulating tape, a rewind roll, and at least one roller; and attaching a second quick release head to the body of the tape applicator, wherein the second quick release head comprises at least one second application roller, a body portion of the second quick release head and a second quick release device.

4. The method of claim 3, further comprising:

at least partially removing an adhesive residue from the at least one roller of the released first quick release head while the second quick release head is attached to the tape applicator; and subsequently releasing the second quick release head from the tape applicator and re-attaching the first quick release head to the tape applicator.

5. A method for switching a quick release head during manufacturing of a photovoltaic module, the method comprising:

supplying a double-sided insulating tape from a supply roll attached to a body of a tape applicator, wherein the body of the tape applicator comprises at least the supply roll, a rewind roll, at least one roller, and a first quick release head, the quick release head comprising at least one first application roller, a body portion of the first quick release head and a first quick release device;

applying the double-sided insulating tape adjacent to a partially completed photovoltaic module with the first quick release head;

releasing the first quick release head from the body of the tape applicator by actuating the first quick release device to service the first quick release head; and attaching a second quick release head to the body of the tape applicator, wherein the second quick release head comprises at least one second application roller, a body portion of the second quick release head and a second quick release device.

6. The method of claim 5, wherein the step of servicing the first quick release head comprises at least partially removing an adhesive residue from the at least one roller of the released first quick release head while the second quick release head is attached to the body of the tape applicator.

* * * * *